United States Patent [19]

Jacobs

[11] 4,093,483

[45] June 6, 1978

[54] PROCESS AND APPARATUS FOR FORMING PLEATS IN A DRAW DRAPE

[75] Inventor: Lawrence O'Quinn Jacobs, Richmond, Va.

[73] Assignee: Plastic Products, Inc., Richmond, Va.

[21] Appl. No.: 767,100

[22] Filed: Feb. 9, 1977

[51] Int. Cl.[2] ..... B31F 1/00; D06J 1/00

[52] U.S. Cl. ..... 156/227; 156/474

[58] Field of Search ..... 156/227, 474; 223/28, 223/32, 34, 35; 160/348

[56] References Cited

U.S. PATENT DOCUMENTS

| | | | |
|---|---|---|---|
| 2,658,551 | 11/1953 | Bender | 156/474 |
| 2,669,955 | 2/1954 | Geltman | 223/30 X |

*Primary Examiner*—David Klein
*Assistant Examiner*—William H. Thrower
*Attorney, Agent, or Firm*—Norman B. Rainer

[57] ABSTRACT

Novel pleat assemblies are formed in the heading of a drapery by simultaneously forming folds of controlled size in said heading and cohesively bonding said folds to a backing strip extending the length of the pleat assembly. The drapery is disposed face up during the process.

The pleat-making apparatus comprises a shaping electrode, a support electrode, and fold-forming means, said shaping electrode being adapted to be urged downwardly into straddling disposition about said fold-forming means and into contact with said support surface electrode.

18 Claims, 8 Drawing Figures

PROCESS AND APPARATUS FOR FORMING PLEATS IN A DRAW DRAPE

BACKGROUND OF THE INVENTION

This invention relates to improvements in the manufacture of draw drapes, and more particularly to a process and apparatus for making permanent pleats in the upper edge of a draw drape.

Draw drapes, as employed for decorative purposes and controllable concealment of areas or passages, generally consist of a flexible sheet structure of fabric or film having a stiffened border known as a "heading" contiguous to the upper edge. The heading accommodates means such as hooks whereby the drape can be suspended from a draw rod or equivalent rigid track mechanism capable of slideably adjusting the drape horizontally to a drawn, compactly folded state, or to its maximum extended length.

Because the drapery is intended to have a pleasing appearance, particularly in its extended state, it is provided with pleats in the heading which cause formation of uniform vertical undulations extending the height of the drape. The undulations present an appearance of depth and natural fullness which is absent in a totally flat fabric. The pleats also serve as anchor sites for the hooks which engage with the draw rod.

Pleats or pleat assemblies are generally comprised of a sharply defined fold or group of several closely spaced folds in the heading, said folds being preserved by sewing or other means. A multitude of such pleats are uniformly spaced along the heading. The size of the folds of the pleats and their spacing is generally such as to produce a pleated heading having about half the length of the initial unpleated heading. The extent of shortening of the pleated heading is a measure of the "fullness" or appearance of the drapery. A pleated draw drape having a heading contracted to 50% of the length of the same heading prior to pleating, is said to have 100% fullness. Greater contractions produce greater fullness, and lesser contractions provide proportionally less fullness.

Several well-known types of pleats are recognized, such as the pinch, box and cartridge styles, each fabricated by a specialized method and having a distinct appearance. For example, a pinch, also known as a French pleat, is made by first forming a vertically oriented loop protruding toward the face of the drape and extending the height of the heading. The loop is then sewn closed at its base and fashioned into three smaller loops or folds by gathering and shaping the protruding fabric and pushing it back toward the heading. The three folds are joined or pinched together by sewing in a direction perpendicular to the face of the drape just below the heading, forming a seam, generally called a bar tacking. Because the folds are joined laterally at one point, the appearance is that of three folds beginning at the top of the drapery, converging just below the heading, and then diverging and leading into the undulations of the body of the drape. Since the center fold is not anchored to the top of the heading, it appearss non-uniform in height, being higher at the top of the heading than at the bottom thereof.

A box pleat is made by initially forming a vertically sewn loop, as in the case of the pinch pleat. The loop is then flattened against the heading, as by pressing, and the top and bottom portions of the flattened loop are horizontally sewn to the heading. A cartridge pleat is similar to a box pleat, but instead of being flattened, the loop remains in its full, protruding configuration.

The present invention is concerned with a pleat which may be described as a straight uniform pleat. It may have 1, 2 or 3 folds within the heading, but unlike the pinch pleat described above, the folds, when 2 or 3 are employed, are not joined together, and each fold is of uniform height throughout its vertical extent from the top to the bottom of the heading.

Because of the attendant contraction in the length of the heading during pleat formation, pleats are generally made one at a time in sequential order. This causes the operation to be slow and costly, particularly when sewing or other relatively slow bonding techniques are utilized. Mechanical methods for pleat making usually involve means for forming the folds in the heading, and means for bonding the folds while held in proper position.

In the pleat-making system of U.S. Pat. No. 2,658,551, the folds of the pleat are formed by causing a group of parallel finger blades to come down upon a thermoplastic fabric positioned above a multi-bladed jig. The fingers enmesh with the blades of the jig, causing the entrapped fabric to take a folded, serpentine path between the blades of the jig and the fingers. A separate thermoplastic backing strip is placed above the folded fabric, and a flat electrode is pressed down upon the assembly. Contact of the flat electrode with the upper edges of the jig produces lines of thermoplastic bonding which preserve the fold structure. The finger blades are then removed from the top of the pleat. Although the approach of U.S. Pat. No. 2,658,551 is effective in principle, in actual practice serious problems are encountered because the thermoplastic backing strip is positioned between the flat electrode and the multi-bladed jig. In this location, the backing strip obstructs the re-positioning of the finger blades. Therefore, in each pleat-making sequence, the backing strip must be diverted away from, then returned to its normal path. This involves not only separate steps of a nature not readily amenable to automation, but creates a high probability of non-uniform alignment of the backing strip in the course of making the pleats of a single drapery. This problem is particularly aggravated by the absence of means for accurately positioning said backing strip. Another unsatisfactory aspect of the process and apparatus of U.S. Pat. No. 2,658,551 is that the drapery is positioned face down on the working surface. This causes difficulties in accurately advancing the pleated section of the fabric, especially in the case of heavy duty draperies. Although this deficiency is recognized in U.S. Pat. No. 2,658,551, and it is disclosed therein, at column 3 lines 65–70 that the positions of the parts may be reversed, such innovation would require additional features to compensate for loss of the gravity-aided positioning of the drapery in the former case.

The use of a backing strip to secure a multi-fold pleat is also disclosed in U.S. Pat. No. 3,392,890 which utilizes adhesive to achieve bonding of the backing strip to the folds of the pleat. Such method is generally slow, and produces an unusually stiff pleat which may not survive aging or cleaning or laundering operations. Although the disclosure concerns a draw drape, the insertion of hooks behind the pleats will be difficult, if not impossible because of the adhesive layer behind each pleat.

It is an object of the present invention to provide a method and apparatus for the production of straight uniform pleats in a draw drape. It is another object to provide a method and apparatus for the rapid production of straigt uniform pleats in the heading of a draw drape and capable of engaging with drapery hooks. It is a still further object of this invention to provide a method and apparatus for the accurate and rapid production of straight uniform pleats having a backing strip and being capable of engaging with drapery hooks in the heading of a draw drape positioned face up during the pleat-making process. Other objects and advantages will appear hereinafter.

SUMMARY OF THE INVENTION

The objects of the present invention are accomplished in general by providing a process wherein a thermoplastic backing strip is accurately positioned on a substantially flat support surface, folds are caused to be formed in the heading of a drapery having a thermoplastic rear surface, said folds being formed by fold-forming means and positioned above said backing strip and in contact therewith in a manner such that said drapery is facing upward, causing said backing strip to cohesively bond in straight parallel lines to the rear surface of said heading, and removing said fold-forming means from the bonded folds; and an apparatus comprising a support surface electrode, fold-forming means adapted for movement in a plane perpendicular to said support surface electrode, and a shaping electrode comprising an aligning holder carrying a number of elongated sealing edges adapted to make continuous contact with said support surface electrode, said sealing edges being adapted to enmesh with said fold-forming means in non-contacting relationship, said support surface electrode being provided with means for positioning a backing strip under said fold-forming means.

DETAILED DESCRIPTION OF THE INVENTION

Figure 1:
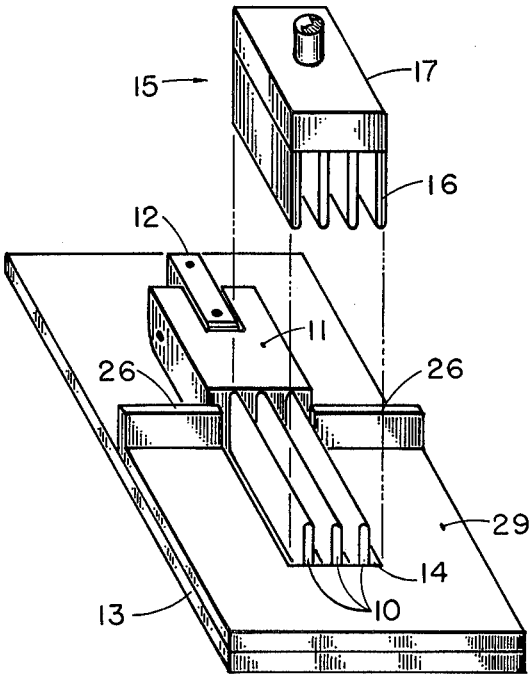
FIG. 1 is a perspective view of an apparatus of the present invention with the fold-forming means and shaping electrode in disengaged position.

In the apparatus illustrated in FIG. 1, fold forming means consisting of three fingers 10 are mounted in harness member 11, which is pivotably connected to anchor block 12 mounted on flat support surface electrode 13. The fingers 10, in their lowermost position, are located directly above recess 14 cut out of flat cover mask 29 resting on support surface electrode 13. The purpose of said recess is to position a rectangular backing strip utilized in the fabrication of the pleat.

Figure 3:
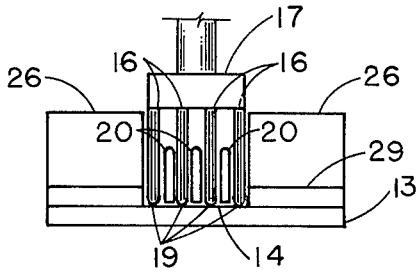
FIG. 3 is a fragmentary front view of the apparatus of FIG. 1 with the fold-forming means and shaping electrode in their inter-engaged position.
Figure 4:
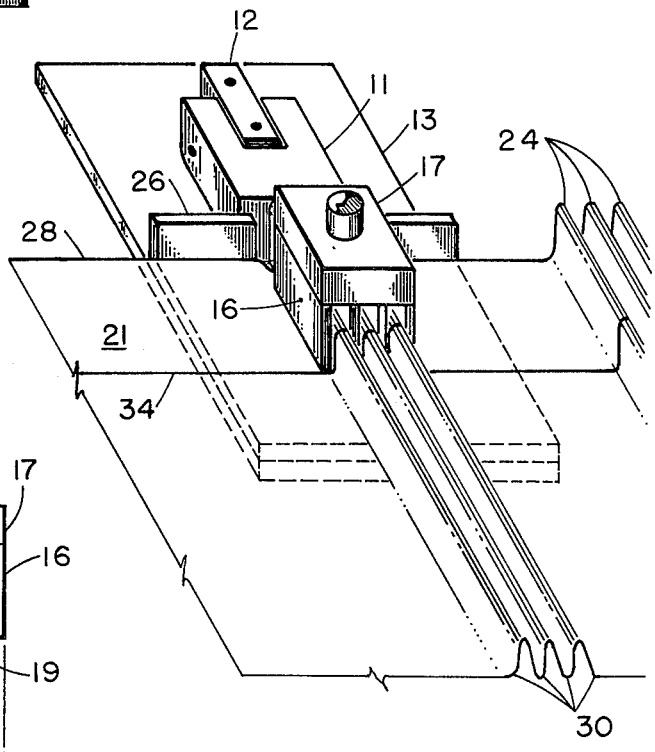
FIG. 4 is another perspective view of the apparatus of FIG. 1 showing the fold-forming means and shaping electrode in their interengaged position acting upon a drapery.

A shaping electrode 15, consisting of four parallel sealing blades 16 mounted in aligning holder 17, is attached via said holder 17 to an overhead pneumatically activated piston mechanism 18. The alignment of the several parts is such that, when shaping electrode 15 is driven to its lowest position by piston mechanism 18, the blades 16 straddle and enmesh with the fingers 10, as shown in FIG. 3, and the sealing edge 19 of each blade 16 makes continuous contact with support surface electrode 13 within recess 14. It is important to note that, in the fully downward position shown in FIG. 3, the fingers 10 do not make contact with either the blades 16 or aligning holder 17.

The shaping electrode 15 and the support surface electrode 13 are separately connected to opposite terminals of an electrical supply system (not shown) in a manner such that the electrical circuit is completed where sealing edges 19 contact or come close to support surface electrode 13. The electrical supply system is one capable of providing high frequency current at a controllable voltage ranging as high as 1000 volts. The frequency of the alternating current is preferably approximately 50 megacycles per second, although satisfactory results may be obtained at frequencies between 100 and 300 megacycles per second. The function of the electrical current is to cause power dissipation in dielectric materials such as plasticized vinyl polymer, with attendant heating to temperatures of at least 140° F to cause fusion and consequent bonding of one surface to another. Satisfactory temperatures are achieved by controlling the voltage, frequency and time duration of the electrical current.

Figure 2:
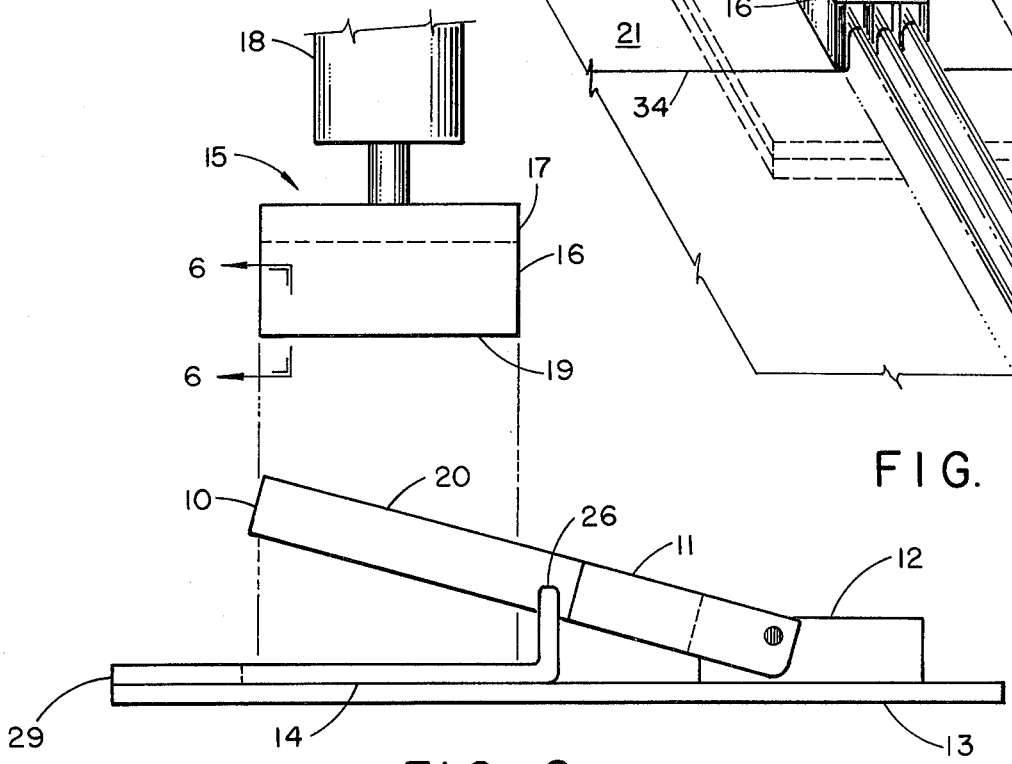
FIG. 2 is a side view of the apparatus of FIG. 1 with the fold-forming means in a raised position.
Figure 8:
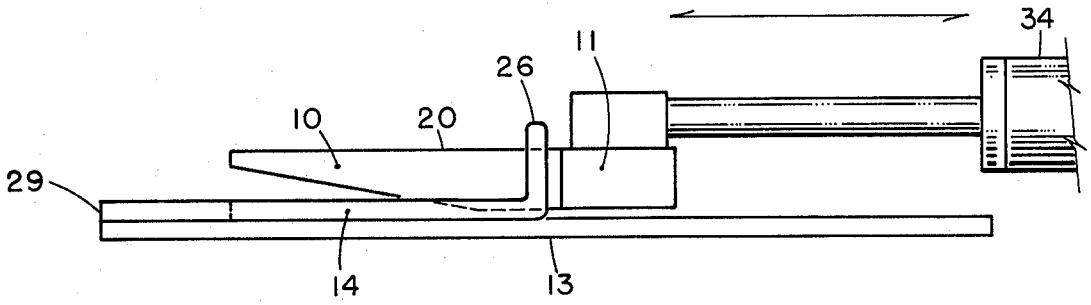
FIG. 8 is a side view of an alternative embodiment of fold-forming means.

The fingers 10 may consist of flat rectangular bars having a length of about 2 to 6 inches, a height of about ½ to 2 inches, and a thickness of about 0.1 to 0.3 inch. The function of the fingers is to establish the location, height and thickness of the folds of the pleat. The most important features of the fingers therefore are the disposition and configuration of upper holding edges 20. The remaining portions of the finger serve to contribute support and alignment to holding edge 20. For example, the flat rectangular bar fingers shown in FIGS. 1 and 2 are designed so that, in operative position, the lower edge of the bar rests on cover mask 29 and spans recess 14. In this manner, holding edge 20 is precisely positioned and extremely resistant to deforming stresses delivered from above. An alternative design of fold-forming finger is shown in FIG. 8 wherein said fingers 10 contain the requisite holding edge 20, but have a bottom edge which, over recess 14, is angled away from cover mask 29. This embodiment facilitates removal of the fingers from the finished pleat.

In some embodiments, the fingers may be readily interchangeable within harness member 11 to facilitate production of pleat assemblies of varied sizes. The fingers may also be disposed or designed to produce folds of different height within the same pleat assembly. The fingers and cooperative sealing edges should be of durable construction, strong and rigid enough to resist deformation under the stresses applied in the pleat-making operations.

The holding edges 20 are preferably straight and adapted to lie parallel to support surface electrode 13 and above recess 14 when said fingers are brought to their operating position. The thickness of holding edge 20 will be generally be the aforesaid thickness of about 0.1 to 0.3 inch. The individual fingers are mounted in harness member 11 in a manner such that, when 2 or 3 fingers are employed, holding edges 20 are parallel and preferably coplanar. It is preferable that the fold-forming means such as fingers 10 be capable of movement so that they can be brought unerringly into and away from operative engagement with support surface electrode 13. A pivoted mode of movement is exemplified in FIGS. 1 and 2. FIG. 8 illustrates fingers 10 mounted in harness member 11 adapted for lateral movement in a direction (indicated by arrows) parallel to support surface electrode 13 by means of lateral positioning device 34. It should be noted that both exemplified modes of movement of said fold-forming fingers are in planes perpendicular to the support surface electrode. The purpose of the adjustability of the location of the fingers or other fold-forming means is to permit access to recess 14, and to facilitate removal of the formed pleat assembly from the fold-forming means. Movement of harness member 11, with consequent repositioning of fingers 10 may be achieved manually or by automated methods. The number of fingers 10 utilized may vary, depending upon the number of folds desired in the pleat.

Figure 6:
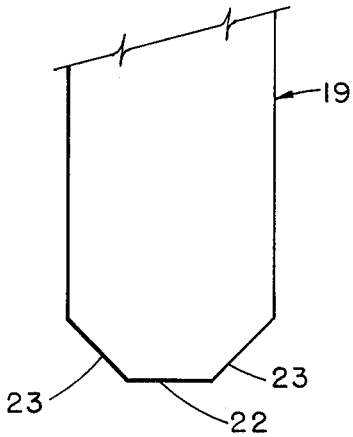
FIG. 6 is an enlarged fragmentary view taken along the lines 6—6 of FIG. 2.
Figure 7:
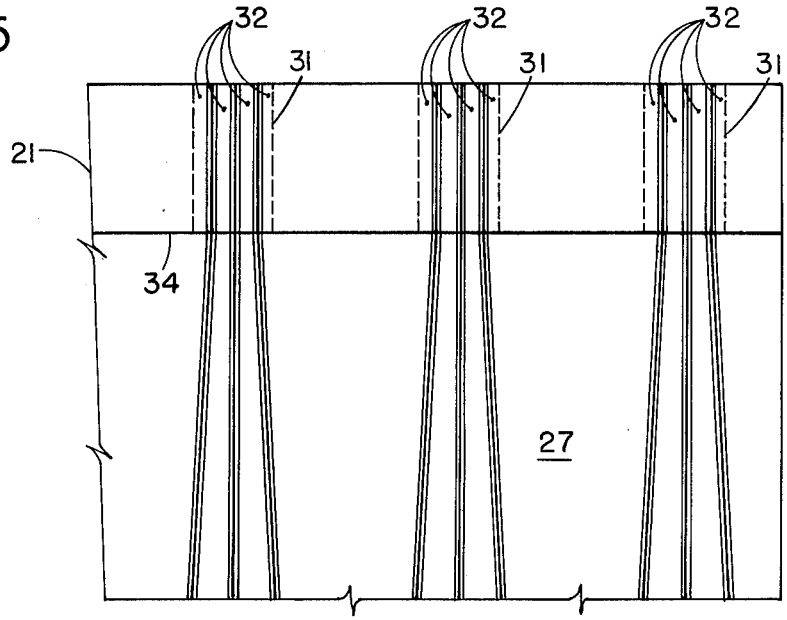
FIG. 7 is a fragmentary view of the rear of a draw drape in extended state having pleat assemblies made by the process of this invention.

The sealing blades 16 function in a manner such as to engage with a stiff but foldable heading 21 bordered by upper edge 28 of drapery 27 and the sewn or cohesively bonded seam 34 which runs parallel to edge 28 and serves to immobilize the bottom of the stiffening member of said heading. The heading, positioned atop fingers 10, is displaced by sealing blades 16 downwardly alongside and/or between said fingers to form folds 24 whose bottoms 30 contact a backing strip contained within recess 14. Accordingly, the most significant feature of each sealing blade 16 is the nature of sealing edge 19, which is straight and located a distance from holder 17 greater than the distance between support surface electrode 13 and holding edges 20 when said holding edges are in their lowest or operative position. As shown more clearly in FIG. 6, each sealing edge 19 preferably consists of a flat leading portion 22 capable of making continuous contact with support surface electrode 13 within recess 14, and beveled or rounded shoulders 23 designed to minimize damage to fabrics being acted upon. Leading portion 22 represents the ultimate path of electrical energy bridging both electrodes and passing through intervening thermoplastic material capable of being bonded by high frequency dielectric heating. Leading portion 22 will generally have a width of about 1/16 to ⅜ inch, and a length of about 1½ to 7 inches. Although the sealing edge 19 has been specifically exemplified herein as being preferably the bottom part of a blade structure, it is obvious from this disclosure that other equivalent sealing edges can be readily designed.

Sealing edges 19 are in electrical continuity with aligning holder 17, and are sufficiently rigid to maintain dimensional stability during use. In some embodiments, the central sealing edge or edges may be resiliently urged to a position below the other sealing edges mounted in the aligning holder. In this manner, the center sealing edge or edges make initial contact with the drapery, causing additional length of drapery material to enter the enmeshing members from the outermost folds. Springs or equivalent means may be recessed within or otherwise associated with the aligning holder to achieve this design. In the fully down position however, all the sealing edges make uniform contact with the face of the drapery in lines equidistantly spaced from the respectively interengaged holding edges 20.

The shaping electrode 15 is connected to means for applying force in a downward direction. Suitable force-applying means include pneumatic and hydraulic rams, rack and pinion mechanisms, and weighted lever systems. Preferred force-applying means are those such as pneumatic rams, which can rapidly apply the desired amount of force, and be rapidly withdrawn, raising the shaping electrode about 3 to 12 inches above the pleat. Support surface electrode 13 may be the bottom platen of a drill press, pneumatic press, or comparable force-applying apparatus. The amount of force which is desirably applied to forming electrode 15 during use is between about 50 to 1000 pounds. The effect of the downward force applied to the shaping electrode 15 and consequently to sealing edges 19 is to cause more intimate contact of the surfaces being bonded for securement of stronger bonds.

Guide means 26 shown in FIGS. 1, 2 and 3 may optionally be employed to aid in positioning the upper edge 28 of drapery 27. Additional optional means may also be used to measure and/or control the distance between adjacent pleats. The recess 14 in cover mask 29 serves to accurately position below the fold-forming means a thin flexible sheet material such as the backing strip utilized in the formation of each pleat. The depth of said recess may range from the thickness of the backing strip to ¼ inch. Additional means may be associated with the recess and cover mask for automatically feeding backing strip material, in which case the feed path may be between support surface electrode 13 and cover mask 29. Cutting means may also be combined with such automated feed system. The cover mask 29 serves only as an expedient means for forming recess 14. As such, any material of uniform thickness may be utilized such as plastics or metals. In the absence of a cover mask, recess 14 could be milled into support surface electrode 13.

The process of the present invention in its preferred mode involves the following steps:

(1) Positioning a substantially rectangular shaped piece of a sheet backing material having thermoplastic properties on an essentially flat support surface,
(2) Positioning fold-forming means above said backing material,
(3) Placing the heading of a drapery having a front surface and thermoplastic rear surface over said fold-forming means and said backing material in a manner such that said front surface is upward,
(4) Forming folds in said heading by causing said fold-forming means to interengage with a shaping means brought vertically downward onto the front surface of the heading,
(5) Bringing the bottoms of said folds into contact with said backing material in straight line regions,
(6) Thermally bonding the bottoms of said folds to said backing material within said straight line regions in abutment with said flat support surface to form a finished pleat,
(7) Raising said shaping means, and
(8) Removing said fold-forming means from said pleat.

Figure 5:
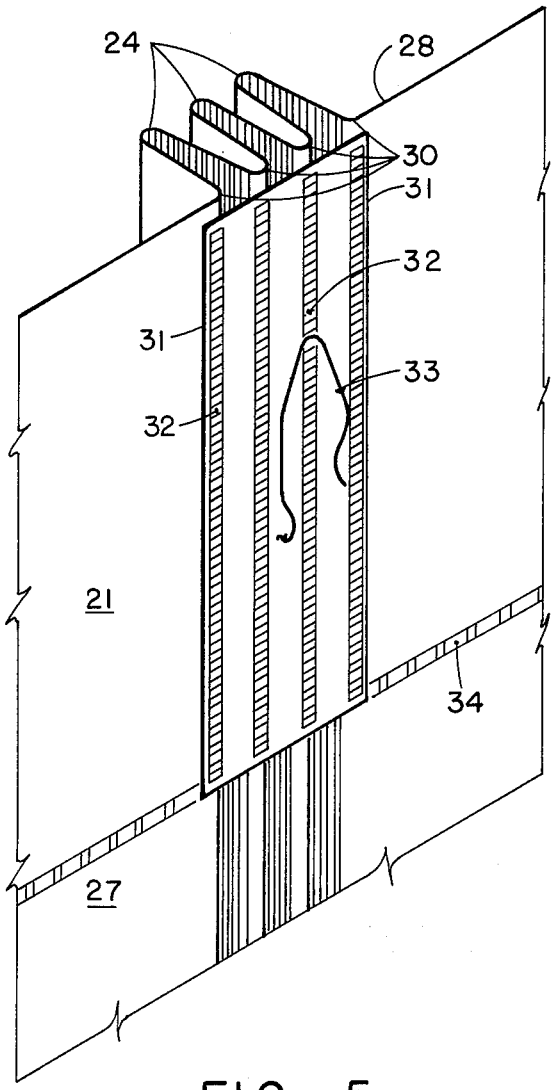
FIG. 5 is a fragmentary perspective view of a draw drape illustrating a pleat assembly made by the method and apparatus of this invention.

Preferred materials for utilization as backing material include flexible fabrics or films comprised at least in part of plasticized polymer of vinyl chloride. Such polymers may be comprised of 50 to 90% of polymerized vinyl chloride, and may contain about 20 to 80% of a plasticizer, generally a non-volatile ester compound such as dioctylphthalate. An especially preferred material is a strong fabric containing either a skim or friction coating or attached film of plasticized poly (vinyl chloride). The backing material may be utilized in the form of separate pieces applied to each pleat, or in the form of a continuous roll, from which pieces of appropriate size are cut as needed for each pleat. The backing material for each pleat is in the form of a rectangular strip 31 as shown in FIG. 5, extending vertically down the heading for the entire length of the pleat. The width of the backing strip is such as to encompass the several lines of bonding 32 in the pleat and is preferably positioned such that its upper edge is flush with upper edge 28 of heading 21. The backing strip should be suitably tear-resistant so that a curtain hook 33 may be inserted through the strip, and the drapery hung therefrom without tearing said backing strip.

The heading of the drapery preferably contains, at least on its underside or rear surface, plasticized poly (vinylchloride) so that when bonding occurs both contacting surfaces will be comprised of plasticized poly (vinylchloride). In this manner, the resultant bonds can be characterized as cohesive bonds wherein one member bridges to another with no intervening interface or change in composition. When such bonds are broken, as in strength-testing, the bonding force involved is essentially the cohesive strength of the polymer substrate. Except for the underside of the heading, the material of which the drapery is fabricated need not possess thermoplastic properties.

The bonding step is preferably initiated at the instant the bottoms of the folds, sometimes referred to as bights, are pressed against the backing strip in abutment with the underlying supporting surface. The length of time required to achieve bonding may range from a fraction of a second to several seconds. Although high frequency dielectric heating is the preferred mode of bonding, other techniques for achieving cohesive bonding may be employed, including ultrasonic methods and heated block methods.

During the pleat-making process, the backing strip and heading fabric are essentially sandwiched between support surface electrode 13 and the flat leading portion 22 of sealing edge 19. Increased pressure on the sandwiched members will increase the rate and the strength of bonding.

Upon completion of the pleat-making operation, shaping electrode 15 is raised and then, usually as a following step, fold-forming fingers 10 are removed from their position of engulfment within the folds of the pleat. Said fingers are removed from the open tops of the folds by a sliding movement essentially in the plane of the drapery. The drapery is then moved to the next location on the heading where a pleat is desired, another backing strip is entered into recess 14, and the pleat-making process is repeated.

Although the process of this invention may be best carried out using the apparatus of this invention, the process can also be carried out using other equipment, and might under some circumstances be carried out by hand. The process is preferably applied to drapery material having a multi-layered heading comprising a stiffening material such as buckram, or the like, sandwiched between front and rear layers of thermoplastic sheet material. Said front layer may be the upper portion of the face of the drapery, and said rear layer may be the integral continuation of said front layer, folded at its upper extreme and flattened upon an intervening buckram strip. The very special advantage of the present process, when applied to said preferred multi-layer headings is that the cohesive bonding step not only forms the pleat assembly in the aforementioned manner, but it also bonds the buckram insert to the outer thermoplastic layers, thereby securing the integrity of the entire pleat and heading construction.

What is claimed is:

1. Apparatus for making pleats in the heading of a drapery comprising a substantially flat support surface electrode, fold-forming means positioned above said support surface electrode and adapted for movement in a plane perpendicular thereto, a shaping electrode connected to means for applying force in a downward direction positioned above said support surface electrode and adapted for vertical movement with respect thereto and comprising holder means carrying 2, 3 or 4 elongated sealing edges adapted to make continuous contact with said support surface electrode and enmesh with said fold-forming means in non-contacting relationship, and recessed positioning means associated with said support surface electrode for confining a thin flexible strip beneath said fold-forming means and said sealing edges, said positioning means being contoured so as to completely encompass the outer periphery of said flexible strip.

2. Apparatus in accordance with claim 1 wherein said support surface electrode and said sealing edges are connected to a source of high frequency electrical current in a manner such that contact of said sealing edges with said support surface electrode completes an electrical circuit.

3. Apparatus in accordance with claim 1 wherein said fold-forming means is comprised of one, two or three elongated fingers, and the number of sealing edges is one greater than the number of fingers.

4. Apparatus of claim 3 containing guide meanss above and contiguous with said support surface electrode, disposed perpendicularly to said fingers.

5. Apparatus of claim 4 wherein said guide means is symmetrically disposed about said fingers.

6. Apparatus of claim 3 wherein said fingers are joined at one end to a harness adapted for movement in a direction perpendicular to said support surface electrode.

7. Apparatus of claim 1 wherein each of said sealing edges is comprised of an elongated flat surface disposed parallel to said support surface electrode and bounded on its two long sides by symmetrically arranged beveled or rounded shoulders.

8. Apparatus of claim 7 wherein said elongated flat surface is rectangular.

9. Apparatus of claim 3 wherein each of said fingers comprises a straight rigid holding edge which in its closest position to said support surface electrode is parallel to said surface and spaced from ½ to 2 inches above same.

10. Apparatus of claim 9 wherein said sealing edges are spaced from said holder means a distance greater than the distance of said straight rigid holding edge from said support surface electrode in its closest position thereto.

11. Process for the production of a straight uniform pleat in the heading of a drapery comprising the steps of:

(a) positioning a piece of a sheet backing material on an essentially flat surface of a positioning means contoured so as to completely encompass the outer periphery of said sheet backing material in a substantially horizontal, motionless disposition, (b) positioning fold-forming means above said backing material, (c) placing the heading of a drapery having a front surface and a rear surface over said fold-forming means in a manner such that said front surface faces upward, and said rear surface contacts said fold-forming means, (d) forming folds in said heading by causing said fold-forming means to interengage with a shaping means brought vertically downward onto the front surface of the heading, (e) causing the bottoms of said folds to contact said backing material in straight line regions, (f) cohesively bonding the bottoms of said folds to said backing material within said straight line regions in abutment with said flat surface to form a finished pleat, (g) raising said shaping means, and (h) removing said fold-forming means from said pleat.

12. Process of claim 11 wherein said backing material has thermoplastic properties.

13. Process of claim 11 wherein the rear surface of said drapery has thermoplastic properties.

14. Process of claim 11 wherein both said backing material and the rear surface of said drapery have thermoplastic properties.

15. Process of claim 12 wherein said thermoplastic properties are provided by the presence of a plasticized polymer of vinyl chloride.

16. Process of claim 11 wherein said cohesive bonding is achieved by thermal means.

17. Process of claim 16 wherein thermal means comprises high frequency electrical energy.

18. Process of claim 11 wherein the heading of said drapery is multi-layered, comprising a stiffening material sandwiched between front and rear layers of thermoplastic sheet material, and the cohesive bonding step additionally accomplishes the bonding of said stiffening material to said thermoplastic layers.

* * * * *